United States Patent [19]

Seulen et al.

[11] 3,967,089

[45] June 29, 1976

[54] APPARATUS FOR THE INDUCTIVE HARDENING OF WORKPIECES ROTATABLE AROUND A ROTATIONAL AXIS

[75] Inventors: Gerhard Seulen; Friedhelm Reinke, both of Remscheid; Edgar Stengel, Wuppertal-Hahnenberg, all of Germany

[73] Assignee: AEG-Elotherm G.m.b.H., Germany

[22] Filed: June 18, 1974

[21] Appl. No.: 481,364

[30] Foreign Application Priority Data

June 28, 1973 Germany ..... 2332832

[52] U.S. Cl. ..... 219/10.67; 219/10.43; 219/10.57; 219/10.79; 266/249

[51] Int. Cl.[2] ..... H05B 5/08; C21D 1/10

[58] Field of Search ..... 219/10.43, 10.57, 10.67, 219/10.79; 266/4 EI, 5 EI

[56] References Cited

UNITED STATES PATENTS

| | | | |
|---|---|---|---|
| 2,574,564 | 11/1951 | Högel et al. | 219/10.79 X |
| 3,247,353 | 4/1966 | Cary | 219/10.57 |
| 3,784,780 | 1/1974 | Laughlin et al. | 219/10.57 X |

*Primary Examiner*—J. V. Truhe
*Assistant Examiner*—N. D. Herkamp
*Attorney, Agent, or Firm*—Cushman, Darby & Cushman

[57] ABSTRACT

Apparatus for inductive hardening of the bearings of crankshafts by a rotational process, wherein various parts of the surface of the workpieces are heated by variably shaped inductors, and wherein the workpiece is loaded horizontally with a hardening carriage, which supports a transformer plate for supporting a transformer connected to a medium frequency current source and an inductor attached to the transformer plate, and an automatic control to move the transformer plate to load and unload separate inductors for treating variably shaped workpiece surfaces.

16 Claims, 5 Drawing Figures

APPARATUS FOR THE INDUCTIVE HARDENING OF WORKPIECES ROTATABLE AROUND A ROTATIONAL AXIS

The invention relates to an apparatus for the inductive hardening of workpieces which are rotatable around a rotational axis. More particularly, this invention relates to an apparatus for the inductive hardening of the bearings of crankshafts by way of a rotational process, wherein various parts of the surface of the workpieces are heated by means of variably shaped inductors, and wherein the workpiece is loaded horizontally with a hardening carriage, which can be fixed in its position in the individual working positions and which is movable in parallel with the axis of rotation of the workpiece. A transformer plate for supporting a transformer is disposed swivelably below support rods and is shiftable along the hardening carriage with regard to height, the transformer being connected by way of flexible primary feed lines with a current source of a medium frequency and with an inductor attached to the transformer plate and only partially enveloping the surface to be hardened.

A semiautomatic device of this type is disclosed in the German Pat. No. 865,321. The apparatus contains a tank in its machine frame for the reception of a liquid quenching agent. A carrier shaft is disposed with a horizontal axis above said tank on which four pairs of grip holders with clamping elements for the reception of crankshafts, etc., are disposed. The grip holders are displaced azimuthally in relation to one another. The crankshaft is connected with a gear unit which, on the one hand, moves the workpieces held in the clamping elements of the grip holders for the purpose of carrying out partial turns of the carrier shaft. The carrier shaft is moved from a clamping station which is accessible to the operation and at which the inductive hardening takes place, step-by-step by way of three stations located in the quenching agent bath and back to the clamping station and serves on the other hand for the rotation of the workpieces about their longitudinal axes.

For the inductive hardening of the bearing surface areas, a hardening carriage has been provided which can be moved on carrier rails at the edge of the quenching tank in the direction parallel to the axis of the carrier shaft. A middle frequency power transformer, to which power is fed by way of flexible supply lines, is connected on its secondary side to the inductor, both electrically as well as rigidly mechanically but releasably. The transformer forms one construction unit with the inductor. The transformer is connected with the hardening carriage by way of its transformer plate and by way of a double rod system which is movable in the manner of a pantograph. The weight of the transformer inductor unit and of the carrier plate together with the rod system is primarily compensated by counter weights, so that the entire inductor block rests during the inductive heating with a relatively low force on the bearing to be hardened.

In operation, four crankshafts are clamped by hand by the operator between the four pairs of grip holders of the carrier shaft. After that, the operator shifts the hardening carriage until the axial position of the inductor agrees with that of the bearing of the crankshaft located in the clamping and heating station which is to be hardened. He then places the inductor mechanically onto the bearing that is to be hardened of the crankshaft which has been put into rotation and starts the inductive heating of the bearing by switching on the inductor current.

The switching off of the inductor current is then accomplished upon completion of the heating by means of a time switch. The inductor then is lifted off automatically and a partial turn of the carrier shaft starts as a result of which the crankshaft is transferred, together with the just heated bearing, for the purpose of quenching into the quenching agent bath and the next shaft is moved into the heating position. After that, the hardening of the corresponding bearing of the crankshaft, which now is in the heating up station, can be accomplished in an analogous manner in the same position of the heating carriage. The process is repeated until the bearings of all clamped-in crankshafts corresponding to this position of the hardening carriage have been hardened.

If the clamped down inductor is to be used for the hardening of several bearings on the crankshaft, the process just described will be repeated in the positions of the hardening carriage corresponding to these bearings. The same takes place each time with one or several other inductors, until all crankshaft bearings have been hardened.

In order to increase the throughput of crankshafts, a variation of this arrangement is known, in the case of which two hardening tanks are disposed one beside the other, each of which has a carrier shaft with grip holders for the clamping down of crankshafts and which are served jointly by hardening carriages movable along both hardening tanks. This construction has the advantage that hardening can proceed in the other hardening tank whenever the loading or unloading of crankshafts takes place at one of the two hardening tanks and vice-versa.

In the case of these semiautomatic arrangements, however, an operator or at least two operators are needed at all times.

For the hardening of crankshafts with large throughput numbers per hour, devices have been provided as disclosed, for example in the German Pat. No. 1,209,137, which have automatic operating arrangements for the inductive hardening of crankshafts. The crankshafts are fed in succession to two hardening stations by means of a transportation arrangement in the direction perpendicular to their axes, in which they are clamped down each time. Several of their bearings are then brought into engagement simultaneously with a corresponding transformer-inductor unit. In the case of a rotating crankshaft, the bearings are then heated inductively by means of the inductors resting on them whereupon quenching takes place with the help of quenching showers connected with these inductors. After that, the crankshaft is stopped in its rotation, is unclamped and moved on.

This known automatically operating apparatus for inductive hardening of crankshafts represents a high technical expenditure in itself and in connection with the increased requirement for performance needed for the simultaneous hardening of several bearings, which expenditure is justified only in the case of very large throughput numbers of the workpieces.

The present invention deals with the task of producing an apparatus for the automatic inductive hardening of surface areas of workpieces having a rotational axis which is automatic except for the clamping in and unclamping process. The present invention is particularly related to the hardening of the bearings of crankshafts, which represents only a little higher expenditure than the above-mentioned semiautomatic apparatus and which permits a simple and quick changeover to another type of shaft and is considerably less expensive than the above-mentioned crankshaft hardening arrangement which operates automatically.

This task is solved in arrangements of the initially designated type according to the present invention by a development which is characterized by an inductor magazine disposed in the range of travel of the hardening carriage, in which the variable inductors can be placed one beside the other along a direction parallel to the rotational axis of the workpiece by an automatically operated coupling for the attachment of the inductor on the transformer plate and for the establishment of the electric connection of the inductor with the secondary connections of the transformer. The invention also includes a program control arrangement for moving of the hardening carriage and the transformer-inductor unit into operating and changing positions as well as for the starting and completion of the individual operating courses.

According to an advantageous development, the arrangement according to the invention is characterized in that the inductor magazine is disposed outside of the axial area of the workpiece-clamping arrangement and in that the arrangement for the moving of the hardening carriage serves as an arrangement for the production of relative axial movement between the inductor magazine and the hardening carriage. At the same time, an arrangement for the production of a relative movement transversely to the axis of the clamping axis for the workpiece between the inductor and a transformer plate is constituted advantageously by an arrangement, known per se, for the vertical movement of the rod system connecting the transformer plate with the hardening carriage.

In another advantageous development the arrangement according to the invention is characterized in that a transfer arrangement provided with a coupling head for the coupling to an inductor is disposed on the hardening carriage for the purpose of transportation of an inductor between an inductor magazine receiving station in a direction deviating from the vertical transversely to the clamping axis of the workpiece, preferably in a direction running horizontal and perpendicular to the clamping axis of the workpiece.

According to a further advantageous development, the arrangement according to the invention is furthermore characterized in that the transfer arrangement has a suitable carrier body developed preferably as a carrier bar, driven in order to carry out this linear movement and guided on the hardening carriage in order to carry out a linear movement transversely to the clamping axis of the workpiece, which carrier body carries a coupling head at one end. At the same time the inductors advantageously can have guide elements, which serve for their guidance on guide rails running in every position of deposit of the inductor magazine as well as arranged on the transformer plate each time in the direction of the movement of the carrier body and they are provided with an arrangement for locking the transformer plate in one position in which its guide rails are aligned with the guide rails of the inductor magazine.

According to another advantageous development of the invention, the inductor magazine is shiftably disposed in relation to the clamping direction of the workpiece, whereby the shifting takes place advantageously in a guide on the hardening carriage.

BRIEF DESCRIPTION OF THE DRAWINGS

By way of example, the invention will be more fully explained in the following detailed description of the preferred embodiments thereof, the appended claims and the accompanying drawings in which:

DETAILED DESCRIPTION OF THE PREFERRED EMBODIMENT

Figure 1:
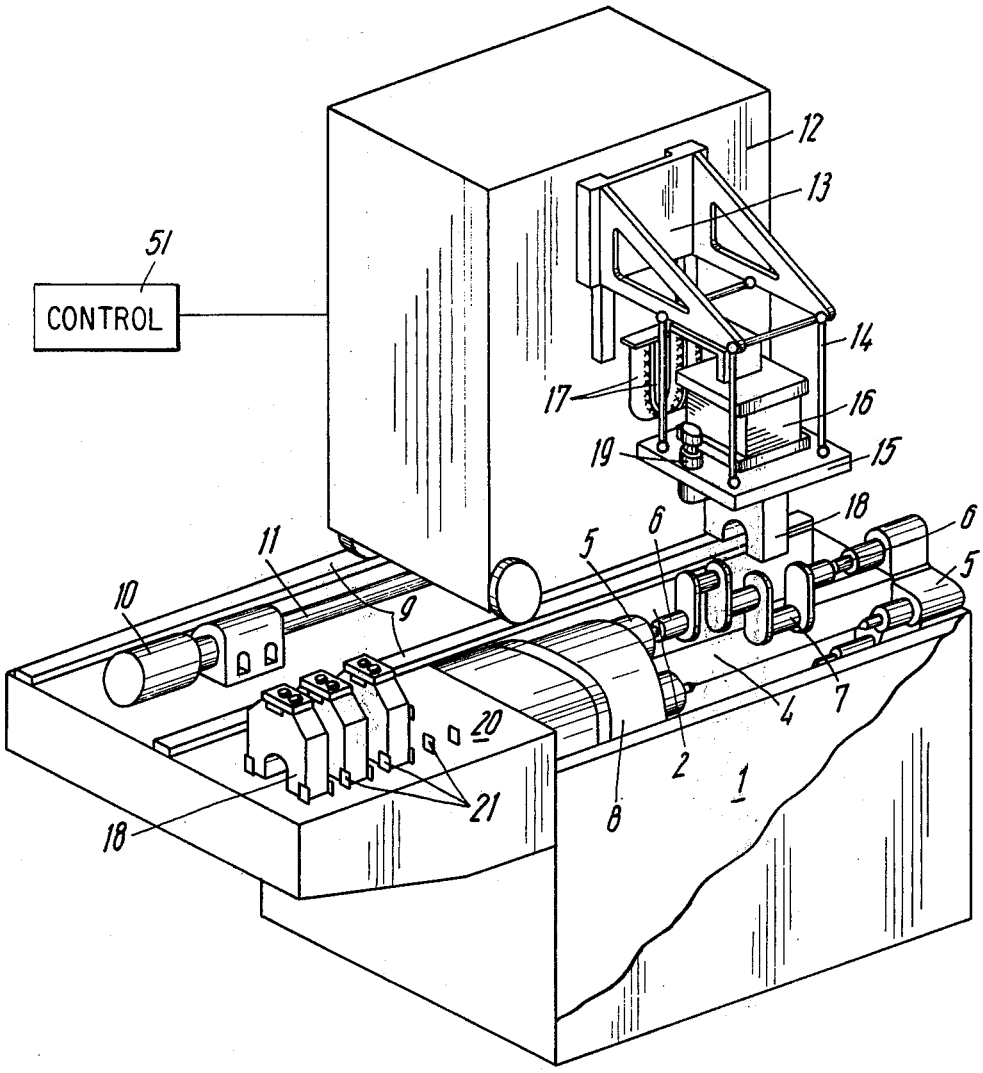
FIG. 1 is a partial schematic perspective illustration of the essential components of the first embodiment of the hardening apparatus for crankshafts which operates automatically except for the process of loading and unloading of the workpieces to be hardened.

The apparatus 1, shown in FIG. 1, has a hardening tank 2 for accommodation of a liquid quenching agent in which a carrier shaft 4 is disposed in a horizontal position. Also positioned in the tank are four pairs of grip holders 5 of which two pairs can be seen in FIG. 1 and which clamp crankshafts 7 between their end points with the aid of spindle sleeves 6. Of the crankshafts carried by carrier shaft 4, for reasons of clarity, only that crankshaft is shown which is in the heating up position outside of the bath containing the quenching agent. For the operation of a partial turn of the carrier shaft 4 as well as the rotation of the crankshaft 7 by means of the spindle sleeves 6, there are gears which are housed in the housing 8.

Furthermore, at the rear edge of the tank a ramp with rails 9 is arranged on the apparatus, on which a hardening carriage 12 can be moved in the direction parallel to the clamping axis of the crankshafts between several predetermined axial positions. The hardening carriage 12 is driven by means of a geared engine 10 and a spindle 11. On the hardening carriage 12, a sled 13 is mounted so that it is vertically movable in guides. A transformer plate 15 is suspended below a swinging, deflectable parallelogram rod system 14 which in turn is connected to the sled 13. The transformer plate 15 can be deflected with the help of the rod system 14 in a direction parallel to the clamping axis of the crankshaft 7. The transformer plate 15 carries a power transformer 16 designed to transform medium frequencies which on its primary side is connected with resonant circuit condensers or with a medium frequency generator arrangement in the hardening carriage 12 by way of flexible supply lines 17. On the secondary side, the transformer is both electrically as well as mechanically rigidly, but releasably connected with the connections of a so-called half-shell inductor indicated by numeral 18, which during operation rests on the bearing that is to be heated inductively by means of flanges (gliding shoes). The weight of the sled 13, the rod system 14 and of the transformer plate 15 together with the weight of the transformer-inductor unit 16, 18 is primarily compensated for by a mass balance housed in the hardening carriage 12.

For coupling the inductor 18 to the secondary of the transformer, coupling elements 19 are provided on both sides of the transformer 16 on the transformer plate 15. The coupling elements are releasable counter to the action of a spring by means of pneumatic adjusting cylinders.

Laterally at the edge of the machine frame beside the quenching tank and outside of the axial area of the clamping arrangement comprising the carrier shaft 4 with the pairs of grip holders 5 and the gear housing 8, an inductor magazine 20 is disposed which includes an arresting plate on which four inductor receptacles are delimited by means of guide pegs 21. A control means 51 of conventional design is shown broken away from the hardening carriage 12. The control means performs the function of controlling the movement of the hardening carriage to move the transformer and inductor into operating position with respect to the workpiece and moves the hardening carriage together with the transformer into position proximate the magazine 20 for changing inductors in the manner set out hereinbelow.

The arrangement operates as follows:

Assume, for example, that four variably formed inductors are necessary for the hardening of all bearings of the crankshaft. Further, assume that the hardening carriage 12 is in the position shown with the sled 13 in its topmost position. In this phase of operation, let, for example, the hardening of all bearings hardenable by means of a coupled inductor be concluded. This state now triggers a starting signal for the inductor change, which is started with the movement of the hardening carriage 12 into the place of the free inductor receptacles on the inductor magazine 20. Then the sled 13 is lowered automatically, so that the inductor 18 comes to rest in the inductor magazine 20 in the receiving spot which hitherto was empty, whereby by operation of an approach switch, the release of the inductor coupling is accomplished and the inductor is thus set down in the inductor receiving place. After that, the sled 13 again moves into its topmost position. The hardening carriage 12 thereupon moves into its predetermined axial position for reception of the next inductor, whereupon the transformer plate 15 is placed on the next inductor by a renewed lowering of the sled 13 and the inductor is coupled with the platform. After a renewed upward movement of the sled 13 into its topmost position, the automatic change of inductors will be completed and the hardening carriage 12 is now moved into the first axial hardening position assigned to the inductor, as a result of which the automatic hardening process of all bearings belonging to this now newly coupled inductor is started.

This hardening process for each axial position of the hardening carriage 12, to be assumed for the purpose of hardening in relation to said inductor, consists of four successive hardening processes, whereby the completion of one hardening process triggers the introduction of the next one. The end of the last, i.e., fourth hardening process, causes the movement of the hardening carriage 12 into its next axial position pertaining to the coupled inductor in which again the four pertinent hardening processes are triggered and so on until all bearings pertaining to the clamped in inductor have been hardened and until the next inductor change operation takes place automatically. This will be continued until all bearings of the clamped in shafts have been hardened and the work operation is stopped for the purpose of unloading the completely hardened crankshafts or for loading with new crankshafts.

Each of the mentioned hardening processes includes the placing of the inductor onto the bearing that is to be hardened by lowering of the sled 13 and by separation of the sled from its lifting apparatus in a manner taught, for example, in German Patent 1,209,137 which relates to automatic hardening arrangements for crankshafts. Then the rotational movement of the shaft is started and the inductor current is switched on. Next, the inductor current is switched off by means of a time switch and the sled 13 is moved upwardly. Finally, the crankshaft 7 is partially turned as a result of which the crankshaft, together with the bearing that has just been inductively heated, is lowered into the quenching bath and another shaft is moved into the heating position. The end of the hardening process then introduces the succeeding hardening process with the lowering of the sled 13 and with placing the inductor onto the bearing to be hardened on the next crankshaft which is stopped in a predetermined azimuthal position.

In order to save one inductor change per hardening period, which period comprises the hardening of the four clamped-in crankshafts, the inductors advantageously should be connected in an inverse sequence with the transformer in each hardening period, than was the case in the immediately preceding hardening period. If therefore, for example, in the first period the inductors have been changed in the sequence A-B-C-D, then the change of inductors in the second period should be in the sequence D-C-B-A and in the third period again in the sequence A-B-C-D, etc. This mode of operation, however, is possible only whenever no technologically predetermined sequence must be maintained during hardening.

Instead of utilizing one hardening tank, the apparatus can be equipped with two hardening tanks in a preferred modification of the embodiment described on the basis of FIG. 1, which tanks have a carrier shaft with grip holders for clamping of the crankshafts. In the case of an apparatus modified in this way, whenever the loading or unloading takes place on one hardening tank, hardening takes place on the other (or vice-versa), and in this way an increased throughput of crankshafts will be achieved.

Figure 2:
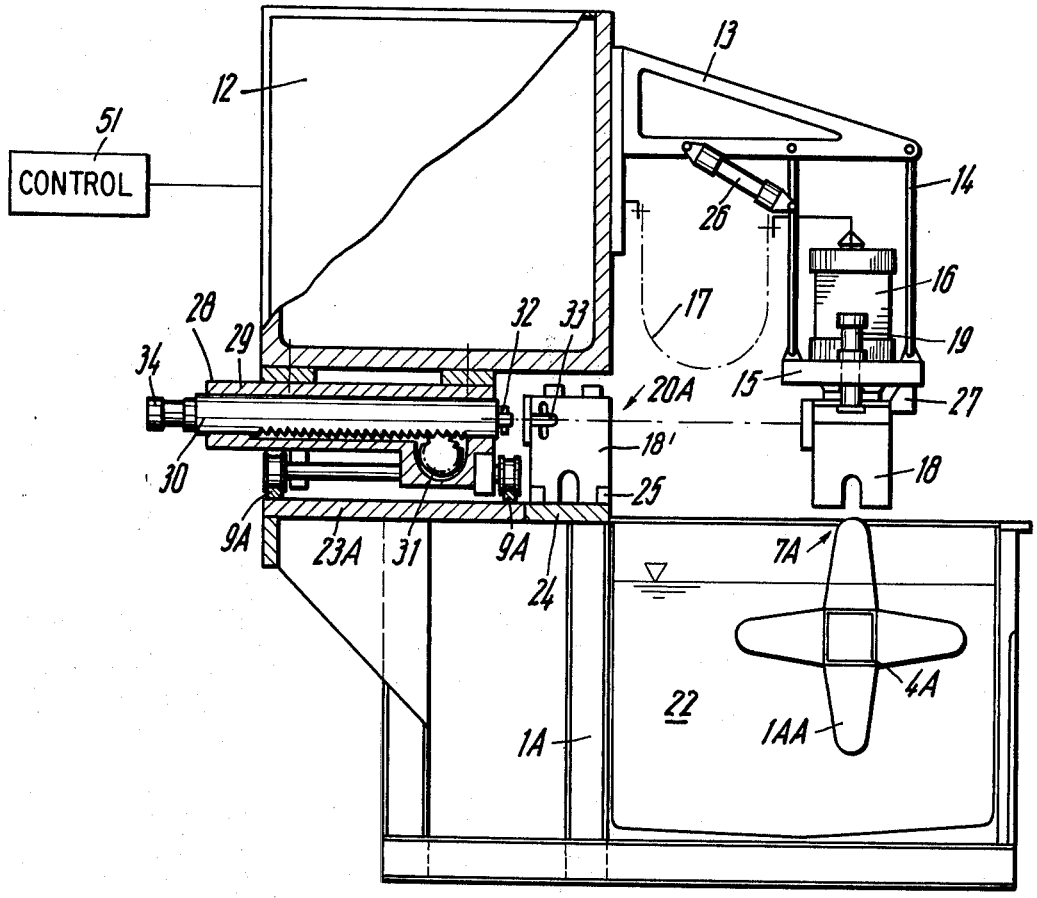
FIG. 2 is a second embodiment showing an apparatus corresponding to the arrangement according to FIG. 1, with a modified arrangement of the inductor magazine.

The variation of the apparatus according to FIG. 2, just like the embodiment according to FIG. 1, has in its machine frame a hardening tank 1A, in which a clamping arrangement 1AA is provided for four crankshafts with carrier shaft 4A and pairs of grip holders having four spindle sleeves. In FIG. 2, only the crankshaft which is located in the heating position outside the quenching bath 22, is designated by 7A. Similarly, as in the case of the variation according to FIG. 1, a ramp 23A with rails 9A is disposed on the rear edge of the tank on which a hardening carriage 12 can be moved parallel to the clamping axis of the crankshafts. The hardening carriage has a vertically movable sled 13 with a transformer plate 15 for supporting a transformer 16 and a connected inductor 18 which is suspended below a swivelable parallelogram rod system 14.

Differing from the embodiment according to FIG. 1, the inductor magazine 20A in the case of this further variation is formed of a strip 24 of the ramp 23A lying between the path of the hardening carriage 12 and the hardening tank 2, on which the inductor reception stations are delimited by guide elements 25. The stopping of the transformer plate 15 in a position for the delivery of the inductors, which is necessary in the case of this variation, takes place by way of a hydraulic clamping cylinder 26 articulated both to the sled 13 of the hardening carriage 12 as well as to the rod system 14 of the transformer plate 15. Beside the coupling elements 19 disposed or made as in the variation according to FIG. 1, the transformer plate 15 has a stop 27 for the inductor 18.

For the transportation of the inductor 18 from the inductor magazine 20A to the transformer plate 15 and vice-versa, there is a transfer arrangement 28 attached on the bottom of the hardening carriage 12, which has a transfer bar 30 sliding in a guide element 29. The transfer bar 30 is axially shifted with the aid of a rack-and-pinion gear 31, the pinion of which is driven by way of a geared engine (not shown) provided with a clutch. The transfer bar 30 has at its end on the inductor side a coupling head developed as a coupling wrench 32, which is suited for engaging with a recess 33 disposed in the inductor housing and developed correspondingly by first a combined forward and then a rotational movement to thereby couple the transfer bar 30 with the inductor. The shaft of the coupling wrench 32 (not shown) is guided in an axial bore of the transfer bar 30 and is connected at the other end of the transfer bar 30 with a driving element 34 which is utilized for the production of a linear and turning movement of the coupling wrench 32.

This arrangement according to FIG. 2 functions in the following manner:

Let the sled 13 at the end of the hardening of all bearings of the four clamped-in crankshafts to be hardened by the connected inductors be in its topmost position and let the hardening carriage 12 be in the axial position corresponding to the hardening of the last of these bearings. Reaching this stage triggers the starting signal for the change of inductor which is introduced with the clamping of the transformer plate 15 by means of the clamping cylinder 26 in the position shown in FIG. 2 and with the movement of the hardening carriage 12 into the place of the emtpy inductor receiving position. For this purpose, the transfer bar 30 being in a withdrawn rest position (as shown in FIG. 2) is pushed forward as far as its extreme outside position by starting the rack-and-pinion gear 31 toward the inductor 18 that is to be uncoupled, in which position the end of the transfer bar just touches the inductor 18, while the coupling wrench 32 is introduced into the corresponding recess in the inductor housing. Due to a succeeding turn of the coupling wrench 32 by means of the driving element 34, the inductor 18 is firmly locked with the end of the transfer bar. The completion of this process introduces the release of the inductor 18 from the transformer plate by releasing of the coupling elements 19, after which the transfer bar 30 is moved in an opposite direction until it reaches a position in which the coupled inductor 18 has reached the position 18' shown in FIG. 2, where it is stopped, controlled by a corresponding signal element. After that, the coupling is released by a correspondingly opposite turn of the coupling wrench 32 and finally there follows the further return of the transfer bar 30 into its withdrawn position shown in FIG. 2. Thus, the process for the transfer of the inductor 18 from the transformer plate 15 into its position 18' in the pertinent receptacle of the inductor magazine 20 has been concluded.

After conclusion of this operating phase, the hardening carriage 12 is now moved into its predetermined axial position for reception of the next inductor that is to be coupled, in which position the process for transferring of an inductor 18 from the inductor magazine 20A to the transformer plate 15, as a second and last phase of the inductor change, is accomplished in such a manner that the processes now take their course in an inverse direction and sequence as in the case of the previously described transfer of an inductor from the transformer plate to an inductor receiving station. After completion of this change, the hardening carriage 12 is moved into its first axial hardening position pertaining to the newly coupled inductor by release of the clamping of the transformer plate brought about by the coupling cylinder 26, with which the automatic hardening for all bearing supports that are to be hardened and belonging to this newly clamped-in inductor, is introduced. The hardening process then takes place in the same way as in the case of the variation of the apparatus according to FIG. 1.

Figure 3:
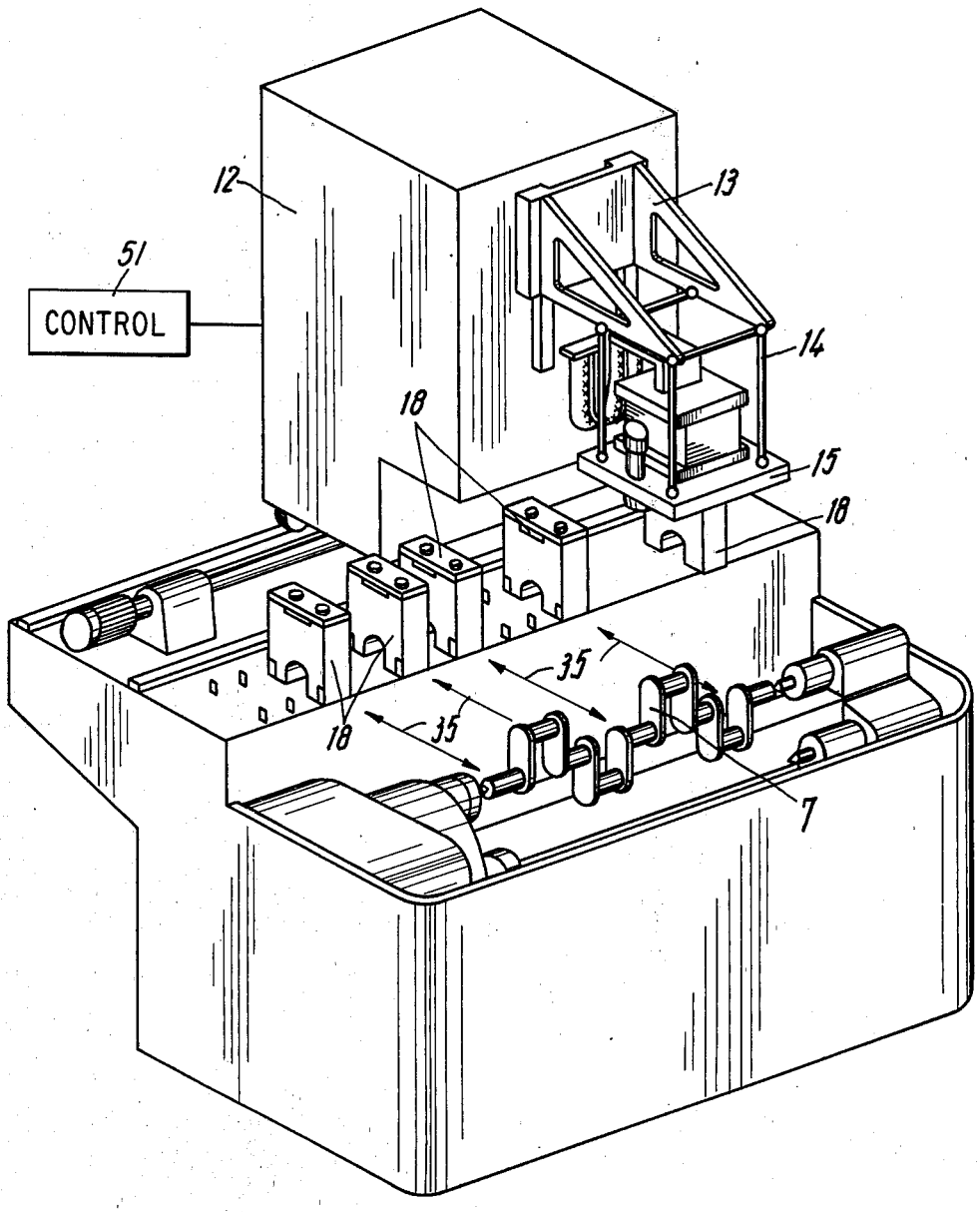
FIG. 3 is a third embodiment showing a variation of the arrangement according to FIG. 2.

FIG. 3 shows the apparatus according to FIG. 2 in a schematic perspective presentation, with an advantageous arrangement of the inductors in the inductor magazine. In the case of this arrangement the position of the inductor in the inductor magazine is aligned, as indicated by lines 35, along the clamping axis of the crankshaft with the axial operating position of the transformer plate for the purpose of hardening of a bearing to be hardened by means of said inductor. This has the advantage that after a completed inductor exchange, the hardening carriage will already be in the axial position for the purpose of starting the hardening process with the newly clamped-in inductor and as a result, one step in the process of operation will be saved or the time expenditure for the total hardening process will be decreased.

Figure 4:
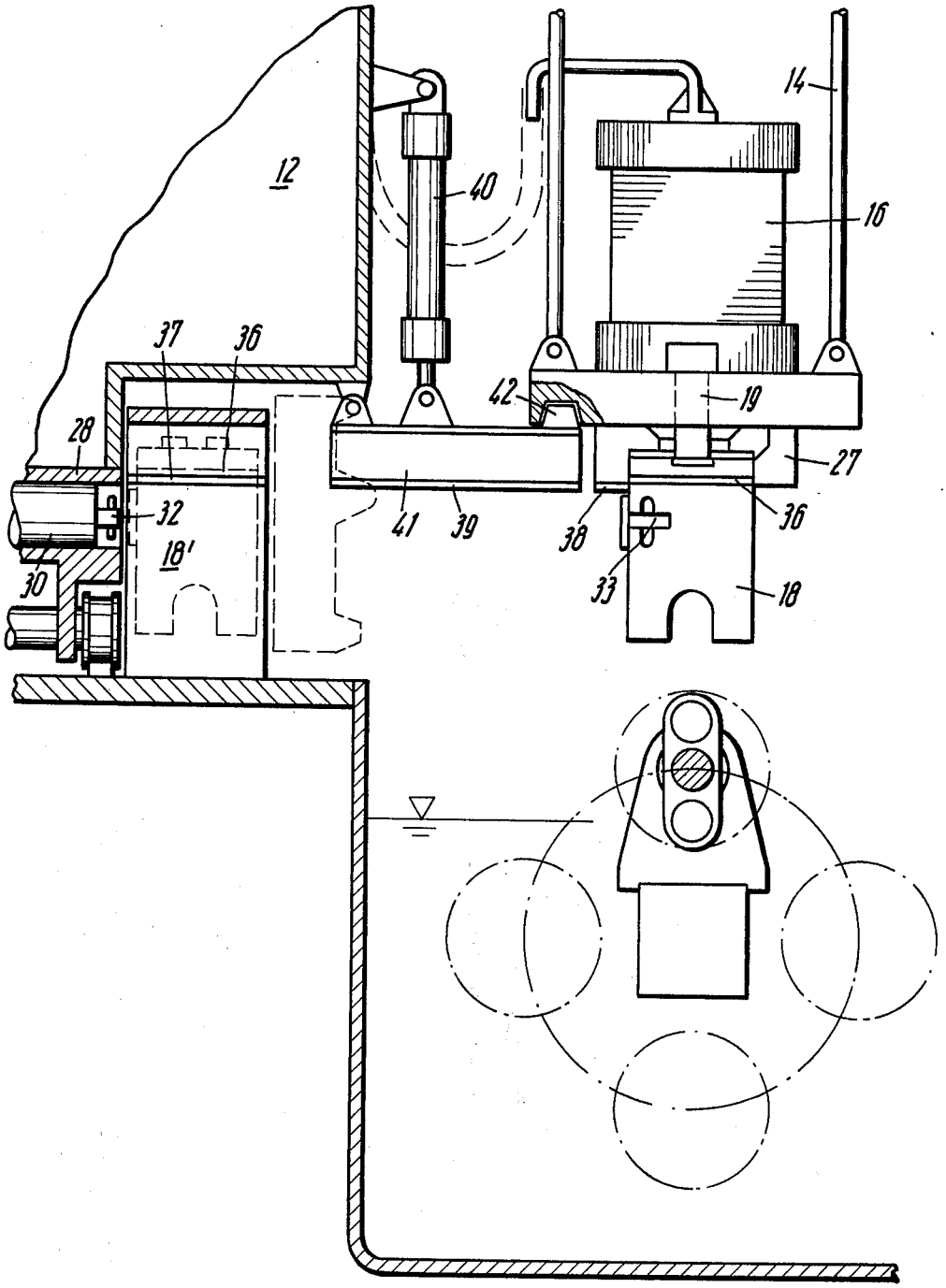
FIG. 4 illustrates an advantageous modification of the embodiment according to FIG. 2.

FIG. 4 is a section view of a variation of the apparatus, which constitutes an advantageous modification of the embodiment according to FIG. 2.

In the case of the arrangement according to FIG. 4, the inductors at both sides of the inductor housing and close to its top edges are provided with sliding rails 36 serving as guide elements, with which they can be guided or movably mounted on guide rails 37, 38 perpendicularly in relation to the clamping axis of the crankshaft. The inductors are attached both in the inductor receiving places of an inductor magazine 20, which has the shape of a housing with several drawers, as well as to the transformer plate 15.

For the purpose of stopping the transformer plate 15 in its transfer position, a bridge 41 which can be operated by a hydraulic shifting arrangement 40 and which is provided the guide rails 39 has been articulated rotatably to the hardening carriage 12, which bridge is provided at its free end with guide pegs 42 and is suited to engage with the former in corresponding peg bores of the transformer plate 15 in such a way that in doing so its guide rails 39 are aligned with the rails 37 and 38 of the transformer plate 15.

Apart from the arresting arrangement, which varies as compared to the modification according to FIG. 2 and in the case of which now the arresting or releasing of the transformer plate 15 in the transfer position takes place solely by swinging up and swinging back of the bridge 41, the construction of the transfer arrangement according to FIG. 4 as well as its course of operation are analogous to that of the variation according to FIG. 2. The transfer arrangement according to FIG. 4, however, can be mechanically constructed considerably more lightly, since it now only needs to serve for the coupling with the inductors or for the shifting, but does not have to carry said inductors.

Figure 5:
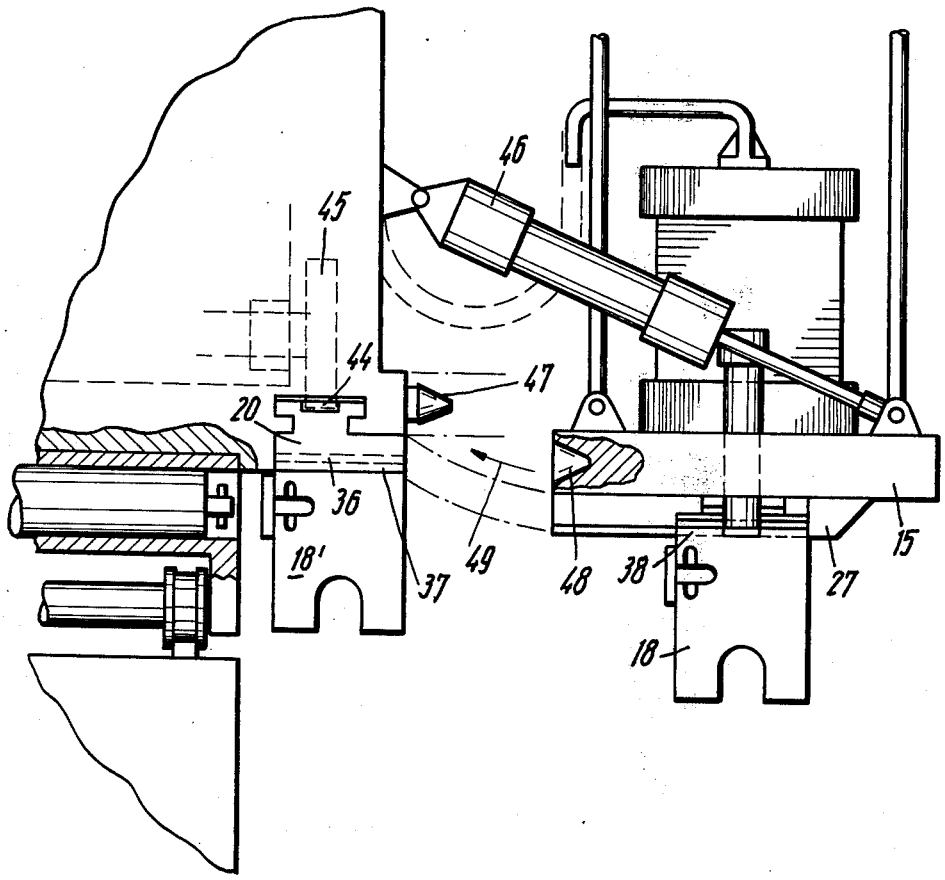
FIG. 5 is a modification of the embodiment according to FIG. 4, shown schematically and in partial section.

Another advantageous variation of an arrangement for the inductive heating of crankshafts which represents a modification of the embodiment according to FIG. 4 is shown schematically and partially in section in FIG. 5.

In the case of this variation, the machine is developed similarly as in the case of the variation according to FIG. 4 with a hardening tank 1 together with a clamping arrangement (4, 5, 6), the hardening carriage 12 being movable on a ramp at the rear edge of the tank 2, with the sled 13 being movable vertically. The transformer-inductor unit (16, 18) is suspended from the sled 13 by way of the parallelogram rod system 14 and the transformer plate 15. In addition, the transfer arrangement 28 on the bottom of the hardening carriage 12 is similar to that of FIG. 4. The inductor magazine 20 on the contrary is shiftably disposed in a guide on the underside of the hardening carriage 12 in the direction parallel to the clamping axis of the crankshafts. The shifting of the inductor magazines is accomplished with the help of a rack-and-pinion gear, in the case of which the rack 44 is connected with the magazine and the pinion 45 with a geared engine (not shown) housed in the hardening carriage 12. The inductor magazine 20, similarly as in the case of the embodiment according to FIG. 3, has a pair of guide rails 37 for every receiving station for the inductors on which the inductors 18 are guided with their sliding rails 36.

Deviating from the embodiment according to FIG. 4, an adjusting cylinder 46 has been provided for the arresting of the transformer plate 15, which is articulated at its ends to the housing of the hardening carriage 12 or to the transformer plate 15. The hardening carriage 12 on its housing has guide pegs 47 which are suitable for engaging with the corresponding recesses on the transformer plate 15.

In the case of this variation of the apparatus according to FIG. 5, let the inductor receiving station, which just happens to be empty, be in a transfer position relative to the transformer plate 15 and let the sled 13 be in its topmost position as shown in FIG. 5 upon introduction of an inductor change. By operation of the adjusting cylinder 46, which is controlled by way of a middle position valve, the transformer plate 15 is now pulled in the direction of the arrow 49 with deflection of the rod system 14 toward the hardening carriage 12 and is coupled to said carriage by engagement of the guide pegs 47 into the recesses 48. In this arrested position of the transformer plate 15, its guide rails 38 are aligned with the guide rails 37 of the inductor reception being in a transfer position.

After further transfer of the inductor 18, which takes place according to the variation according to FIG. 4, into the pertinent receiving place of the inductor magazine 20, the latter is shifted as related to the hardening carriage into a position in which the inductor, which is now to be coupled, is located in a transfer position in relation to the transformer plate 15. After that, the transfer of the inductor that is to be coupled takes place by a completion of the processes in a reverse direction and sequence than in the case of the previously described transfer of the inductor from the transformer plate into the pertinent inductor receiving plate.

This variation of the apparatus among other things has the advantage that an inductor change is possible simultaneously with a movement of the hardening carriage 12 into a new position, which means a considerable saving in time. In the course of operation, whenever the hardening of the last bearing to be hardened by the coupled inductor is completed, the shifting of the hardening carriage 12 can already be accomplished into the position along the crankshaft, in which the first hardening is to take place with the next coupled inductor while the inductor change takes place.

For the control of the automatic course of operation in the case of the apparatuses described, there are utilized control elements which are known per se, such as terminal and approach switches which, in the case of a predetermined shifting of a part of the apparatus or time switches which bring about the completion of the pertinent step of the apparatus, for example in the case of the switching on period of the inductor current, they deliver at the same time a signal for the introduction of the operating step of the apparatus in accordance with a program. A cam strip with cams adjustable along the path of the hardening carriage is arranged for example for stopping the hardening carriage in its operating or inductor exchange positions on the machine frame, which cams operate terminal switches attached to the hardening carriage. A changeover of the apparatus to another type of crankshaft can take place at the same time merely by utilizing a corresponding new complement on the inductor magazine of inductors pertaining to the new type of crankshaft, a corresponding changeing of the heating time, heating performance and compensating condensers for each inductor as well as by a new adjustment of the cams of the above-mentioned cam strip.

Deviating from the described arrangements, all of which operate automatically except for the clamping-in or unclamping process of the workpiece, the apparatus according to the invention can also be equipped with automatically operating arrangements for the supply of workpieces, for the clamping-in and unclamping and for the removal of the workpieces, as is known for example from the apparatus described in the German Patent 1,209,137. In that case, the inductors are combined with quenching showers and the quenching takes place in the heating position of the workpiece. Such an arrangement then operates fully automatically, that is to say the course of hardening, including the loading and unloading processes of the machine, takes place automatically.

What is claimed is:

1. An apparatus for the inductive hardening of workpieces which are rotatable about a rotational axis wherein various parts of the surface of the workpieces are heated by means of variably shaped inductors and wherein the workpiece is clamped horizontally with respect to a hardening carriage, said apparatus including means for moving said hardening carriage parallel to the rotational axis of said workpiece to selected operating positions, and a transformer plate which is vertically movable with respect to said hardening carriage, said transformer plate supporting a transformer thereon, the primary of said transformer being connected to a source of medium frequency power, the secondary of said transformer being connected to one of said inductors, said inductor being fixedly and removably attached to said transformer plate, the improvement comprising:

an inductor magazine disposed in the travel range of the hardening carriage, said variably shaped inductors being deposited one beside another in a parallel direction along one of the rotational axes of the workpieces in said magazine, an automatically operated clutch for attaching an inductor to the transformer plate and for electrically connecting the inductor with the secondary of the transformer, and a program control means for moving the hardening carriage and the transformer and inductor into operating position for the inductive hardening of said workpieces and into changing positions proximate said magazine for changing said inductors.

2. Apparatus as in claim 1 wherein the inductor magazine is disposed along an axial extension of the rotational axes of the workpieces beside said rotational axis and means for moving the transformer plate with the hardening carriage into transverse alignment with a selected one of said inductors of the inductor magazine.

3. Apparatus as in claim 1 wherein the transformer plate is adjustably mounted as to height in relation to the inductors of the inductor magazine.

4. Apparatus as in claim 1 further comprising a transfer means for coupling to an inductor and for transporting said inductor between the inductor magazine and the transformer plate in a direction transverse to the rotational axis of the workpiece.

5. Apparatus as in claim 4 wherein said transfer means further includes a carrier body for carrying out a linear movement transverse to the rotational axis of the workpiece, said carriage body being guided on the hardening carriage.

6. Apparatus as in claim 5 wherein the direction of movement of the carrier body is horizontal and vertical to the rotational axis of the workpiece.

7. Apparatus as in claim 6 wherein the carrier body comprises a carrier bar.

8. Apparatus as in claim 7, further comprising a coupling head fixedly secured to said carrier bar, said coupling head having a coupling wrench which is engageable with a coupling recess of the inductor by way of a linear and rotational movement.

9. Apparatus as in claim 8, further comprising guide elements in said inductors for guiding said inductors on guide rails running in the direction of movement of the carrier body and further comprising means for locking the transformer plate in one position wherein its guide rails are aligned with the guide rails of the inductor magazine.

10. Apparatus as in claim 9 further comprising a rotatable bridge for locking the transformer plate on the hardening carriage, said rotatable bridge including guide rails, said rotatable bridge being engageable at its free end with guide pegs in peg bores of the transformer plate thereby connecting by means of its guide rails the guide rails of the transformer plate with guide rails of the inductor magazine.

11. Apparatus as in claim 9 further comprising means acting between the hardening carriage and the transformer plate for raising up the transformer plate while deflecting its suspension means to an inductor receiving station of the inductor magazine.

12. Apparatus as in claim 11 further comprising guide pegs for engaging with the recesses of the transformer plate for stopping the transformer plate in the predetermined position.

13. Apparatus as in claim 12, wherein the inductor magazine is disposed on support means shiftable in relation to the clamping arrangement of the workpiece.

14. Apparatus as in claim 13 wherein the inductor magazine is disposed on support means shiftable in a guide system on the hardening carriage by a means for adjusting the position of said inductor magazine.

15. Apparatus as in claim 14 wherein the guide pegs are attached to the housing of the hardening carriage.

16. Apparatus as in claim 12 wherein the inductor receiving stations of an inductor magazine, which are stationary in relation to the clamping arrangement of the workpiece, are aligned in a direction transverse to the clamping axis of the workpiece and with the axial operating positions of the transformer plate.

* * * * *